United States Patent [19]

Shigetoshi et al.

[11] Patent Number: 4,998,998

[45] Date of Patent: Mar. 12, 1991

[54] SHEET DISCRIMINATING APPARATUS

[75] Inventors: Imai Shigetoshi, Settsu; Yasuhiko Matoba, Sakai, both of Japan

[73] Assignee: Laurel Bank Machines Co., Ltd., Tokyo, Japan

[21] Appl. No.: 390,883

[22] Filed: Aug. 8, 1989

[30] Foreign Application Priority Data

Aug. 12, 1988 [JP] Japan ..... 63-106705

[51] Int. Cl.[5] ..... B65H 7/14

[52] U.S. Cl. ..... 271/263

[58] Field of Search ..... 271/263, 258, 259, 265

[56] References Cited

U.S. PATENT DOCUMENTS

| | | | |
|---|---|---|---|
| 4,462,587 | 7/1984 | Graef | 271/263 |
| 4,491,929 | 1/1985 | Ikoma | 271/263 X |
| 4,605,926 | 8/1986 | Onishi | 271/263 X |
| 4,703,172 | 10/1987 | Sherman | 271/263 X |
| 4,741,526 | 5/1988 | Reed | 271/263 X |
| 4,761,002 | 8/1988 | Reed | 271/263 |

FOREIGN PATENT DOCUMENTS

| | | |
|---|---|---|
| 28478 | 3/1978 | Japan . |
| 1473233 | 5/1977 | United Kingdom . |
| 2064111 | 6/1981 | United Kingdom . |
| 1597005 | 9/1981 | United Kingdom . |
| 2204682 | 11/1988 | United Kingdom . |

*Primary Examiner*—Richard A. Schacher

*Attorney, Agent, or Firm*—Fleit, Jacobson, Cohn, Price, Holman & Stern

[57] ABSTRACT

A sheet discriminating apparatus including a light emitter for emitting light onto a sheet being transported, a light receiver for detecting an amount of light transmitted through the sheet and a sheet discriminator for discriminating a specified kind of the sheet from others and/or abnormal feed of sheets based upon the amount of light transmitted through the sheet detected by the light receiver, the sheet discriminator including an average value calculator for calculating an average value of the amount of light transmitted through the sheet detected by the light receiver at a predetermined time intervals, a reference data calculator for calculating and storing a reference data based upon the average value of the amount of light transmitted through a preceding sheet to the sheet to be discriminated stored in the average value calculator, and an average data comparator for comparing the average value of the amount of light transmitted through the sheet calculated in the average value calculator with the reference data calculated by the reference data calculator and discriminating the specified kind of sheet from others and/or abnormal feed. The thus constituted apparatus can discriminate whether or not sheets are of a specified kind and/or whether or not abnormal feed of sheets such as double feed occurs for various kind of sheets.

4 Claims, 4 Drawing Sheets

SHEET DISCRIMINATING APPARATUS

BACKGROUND OF THE INVENTION

The present invention relates to a sheet discriminating apparatus, and, more particularly, to such an apparatus for discriminating whether or not a sheet is of a specified kind and/or whether or not abnormal feed such as double fed occurs by exposing the sheet to light and detecting the amount of light transmitted through the sheet.

DESCRIPTION OF THE PRIOR ART

Japanese Utility Model Publication No. 53(1978)-28478 proposes an apparatus which is provided with two photosensors each consisting of a light emitting element and a light receiving element disposed along a transporting path of sheets, detects light transmitted through the sheet by the photosensor disposed upstream, after the photosensor disposed downstream detects the leading edge of the sheet, and discriminates whether or not the sheet is of a specified kind and whether or not abnormal feed such as double feed occurs.

In this apparatus, the downstream photosensor detects the position of the sheet from which the detection of light transmitted through the sheet should be started and discrimination is made as to whether or not the sheet is a specified kind and whether or not abnormal feed occurs by detecting light transmitted through the sheet by the upstream photosensor.

However, since the distance between the photosensors is fixed in this apparatus, detection of transmitted light for discrimination sheet is always started from the same position of the sheet regardless of the kind of the sheet. Therefore, in the case where the photosensors are arranged so that a specified kind of sheet can be discriminated from others with high accuracy, it is extremely difficult to discriminate other kinds of sheets with sufficient accuracy.

SUMMARY OF THE INVENTION

It is, therefore, an object of the present invention to provide a sheet discriminating apparatus capable of discriminating various kinds of sheets as to whether or not a sheet is of a specified kind and/or whether or not abnormal feed of sheets, such as double feed, has occurred, with high accuracy.

According to the present invention, the above and other objects can be accomplished by a sheet discriminating apparatus comprising light emitting means for emitting light onto a sheet being transported, light receiving means for detecting the amount of light transmitted through the sheet and sheet discriminating means for discriminating a specified kind of the sheet from others and/or abnormal feed of sheets based upon the amount of light transmitted through the sheet detected by said light receiving means, said sheet discriminating means comprising average value calculating and storing means for calculating and storing the average value of the amount of light transmitted through the sheet detected by said light receiving means at a predetermined time intervals, reference data calculating and storing means for calculating and storing a reference data based upon the average value of the amount of light transmitted through a preceding sheet to the sheet to be discriminated stored in said average value calculating and storing means, and average data comparing means for comparing the average value of the amount of light transmitted through the sheet calculated in said average value calculating and storing means with the reference data calculated by said reference data calculating and storing means and discriminating the specified kind of sheet from others and/or abnormal feed.

In a preferred aspect of the present invention, the sheet discriminating means further includes summation value calculating and storing means for calculating and storing a summation value by summing the average values calculated by and stored in said average value calculating and storing means over the entire area of the sheet, reference summation value calculating and storing means for calculating and storing a reference summation data based upon the summation value of the amount of light transmitted through the preceding sheet to the sheet to be discriminated stored in said summation value calculating and storing means, and summation value comparing means for comparing the summation value calculated by said summation value calculating and storing means with the reference summation value calculated by said reference summation value calculating and storing means and discriminating the specified kind of the sheet from others and/or abnormal feed of sheets.

In a further preferred aspect of the present invention, said sheet discriminating means further includes length calculating and storing means for calculating and storing the length of the sheet based upon the amount of light transmitted through the sheet detected by said light receiving means, reference length data calculating and storing means for calculating and storing a reference length data based upon the length of the preceding sheet to the sheet to be discriminated stored in said length calculating and storing means, and length data comparing means for comparing the length of the sheet calculated by said length calculating and storing means with the reference length data calculated by said reference length data calculating and storing means and discriminating the specified kind of the sheet from others and/or abnormal feed of sheets.

In a further preferred aspect of the present invention, said sheet discriminating means further includes summation value calculating and storing means for calculating and storing summation value by summing the average value calculated by and stored in said average value calculating and storing means over the entire area of the sheet, reference summation value calculating and storing means for calculating and storing a reference summation data based upon the summation value of the amount of light transmitted through the preceding sheet to the sheet to be discriminated stored in said summation value calculating and storing means, summation value comparing means for comparing the summation value calculated by said summation value calculating and storing means with the reference summation value calculated by said reference summation value calculating and storing means and discriminating the specified kind of the sheet from others and/or abnormal feed of sheets, length calculating and storing means for calculating and storing the length of the sheet based upon the amount of light transmitted through the sheet detected by said light receiving means, reference length data calculating and storing means for calculating and storing a reference length data based upon the length of the preceding sheet to the sheet to be discriminated stored in said length calculating and storing means, and length data comparing means for comparing the length of the sheet calculated by said length calculating and storing means with the reference length data calculated by said reference length data calculating and storing means and discriminating the specified kind of the sheet from others and/or abnormal feed of sheets.

The above and other objects and features of present invention will become apparent from the following description made with reference to the accompanying drawings.

DESCRIPTION OF THE PREFERRED EMBODIMENTS

Figure 1:
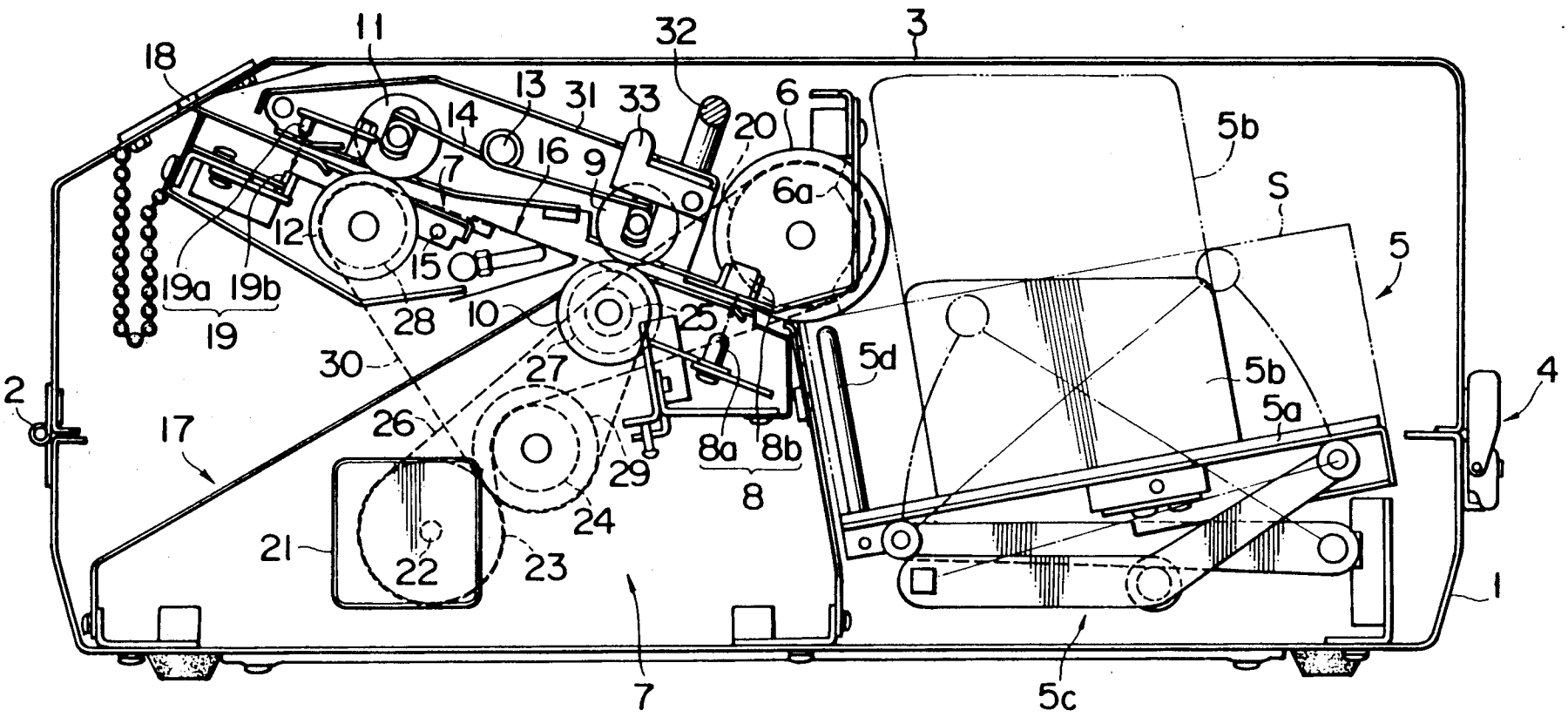
FIG. 1 is a schematic drawing showing a left side view of the internal mechanism of a ballot issuing machine having a ballot discriminating apparatus which is an embodiment of the present invention.

Referring to FIG. 1, a ballot issuing machine 1 having a ballot descriminating apparatus which is an embodiment of the present invention is provided with an upper cover 3 able to be opened upwardly about a hinge 2 provided on the front face of the machine 1 and a lock mechanism 4 at the rear face of the machine 1 for engaging the upper cover 3 with the machine 1. Further, a ballot storing section 5 is provided at a rear portion in the machine 1 for storing ballots.

The ballot storing section 5 comprises a holding plate 5*a* inclined forwardly and downwardly for holding the ballots on the upper face thereof, a pair of side plates 5*b* disposed at opposite sides of the holding plates 5*a*, an lifting mechanism 5*c* for lifting a front end of the holding plate 5*a* each time a ballot is issued, and a guide 5*d* for guiding the front end of the holding plate 5*a* while the front end of the holding plate is lifted.

Figure 2:
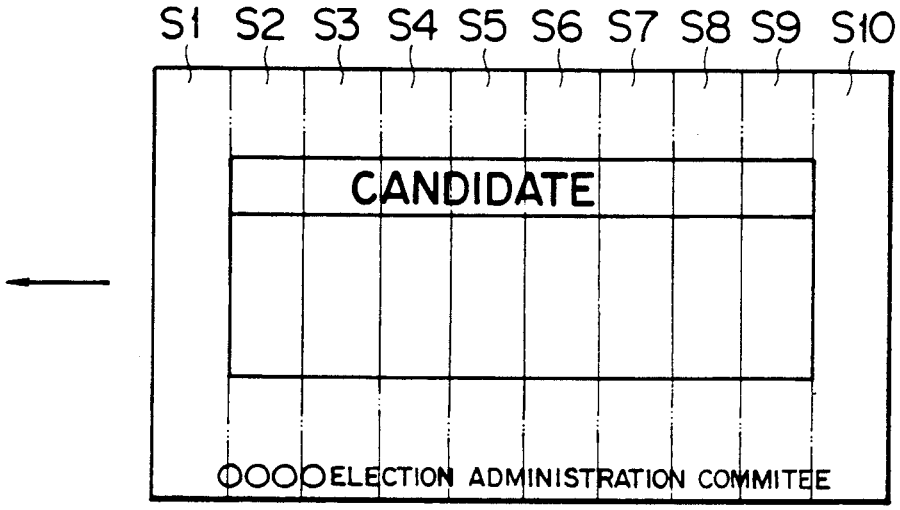
FIG. 2 is a schematic drawing showing a plan view of an example of a ballot to be issued by a ballot issuing machine having a ballot discriminating apparatus which is an embodiment of the present invention.

FIG. 2 shows an example of the ballot S and the ballots S are held on the holding plate 5*a* in the ballot storing section 5 so that the printed side thereof faces upwardly.

A take-out roller 6 is provided at an upper and front portion of the ballot storing section 5 and a part of a circumference of the take-out roller 6 is formed with a friction section 6*a*. The ballots S are fed out one by one from the ballot storing section 5 to a transporting path 7 by frictional force produced between the friction section 6*a* and an upper face of the uppermost ballot S held by the upper face of the holding plate 5*a*. The transporting path 7 is arranged so as to be inclined forwardly and upwardly.

In the vicinity of the take-out roller 6 in the transporting path 7, there is provided a first photosensor 8 consisting of a light emitting element 8*a* and a light receiving element 8*b* which receives light emitted from the light emitted element 8*a* and transmitted through the ballot S being taken out by the take-out roller 6.

Downstream of the first sensor 8 in the transporting path 7, a pair of first transporting rollers 9, 10, facing each other across the transporting path 7, and a pair of second rollers 11, 12, facing each other across the transporting path 7, are provided. The first transporting roller 9 and the second transporting roller 11, which are disposed above the transporting path 7, are biased downwardly by a plate-like spring 14 supported by a shaft 13 so as to press the first transporting roller 10 and the second transporting roller 12 respectively.

Figure 3:
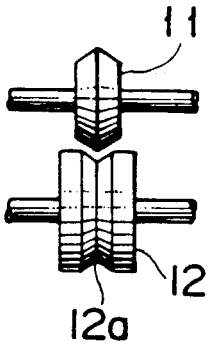
FIG. 3 is a schematic drawing showing a cross-sectional view of second transporting rollers.

As shown in FIG. 3, the circumference of the second transporting roller 11 is formed in such a manner that a central portion thereof projects and, on the other hand, the circumference of the second transporting roller 12 is formed with an annular groove 12*a* at a central portion thereof. As a result, the ballot S is formed with a crease by being transported by the second transporting rollers 11, 12.

Between the pair of first rollers 9, 10 and the pair of second rollers 11, 12 in the transporting path 7, there is provided a switching fork 16 rotatable about a shaft 15 by a solenoid (not shown) and in cases where the first sensor 8 detects a ballot S erroneously printed or such abnormal feed of ballots S that the ballots S are not taken out one by one by the take-out roller 6, the solenoid is driven so that the switching fork 16 projects above the transporting path 7 to collect the ballots S to a collecting passage 17.

The circumferential speed of the first rollers 9, 10 and the second rollers 11, 12 are determined greater than that of the take-out roller 6 and the ballots S taken out from the ballot storing section 5 by the friction section 6*a* of the take-out roller 6 are transported by the first transporting rollers 9, 10 and the second transporting rollers 11, 12 so that their transporting speed is accelerated. The ballot S is fed by one rotation of the take-out roller 6 to such a position that a part thereof projects from a ballot issuing opening 18 to the outside so as to be removable.

Downstream of the second transporting rollers 11, 12 in the transporting path 7, there is provided a second sensor 19 consisting of a light emitting element 19*a* and a light receiving element 19*b*. The second sensor 19 is disposed at such a position that light emitted from the light emitting element 19*a* is interrupted by the ballot S when the ballot S stands still as a result of one rotation of the take-out roller 6 so that a part thereof projects from the ballot issuing opening 18 to the outside. Therefore, it is possible to detect whether or not the ballot S has been removed from the ballot issuing machine 1 by having the light receiving element 19*b* detect the amount of light emitted from the light emitting element 19*a* and transmitted through the ballot S.

The take-out roller 6 is coaxially and integrally formed with a pulley 20 and an endless belt 26 is engaged with the pulley 20, a drive pulley 23 integrally formed on an output shaft 22 of a drive motor 21, a pulley 24 and a pulley 25 coaxially formed on the first roller 10. A pulley 27 and a pulley 28 are coaxially and integrally formed on the first roller 10 and the second roller 12 respectively. An endless belt 30 is engaged with the pulley 27, the pulley 28, and a pulley 29 coaxially and integrally formed on the pulley 24.

Further, there is provided a transporting path cover 31 for covering the transporting path 7 downstream of the take-out roller 6 so that the transporting path 7 can be exposed to the outside by opening the upper cover 3 and pulling a handle 32 of the transporting path cover 31. The transporting cover 31 is normally held at a predetermined position by an engaging member 33.

Although not shown in FIG. 1, separate keys for use by male and female voters are provided on an operation panel on the outer face of the ballot issuing machine 1.

Figure 4:
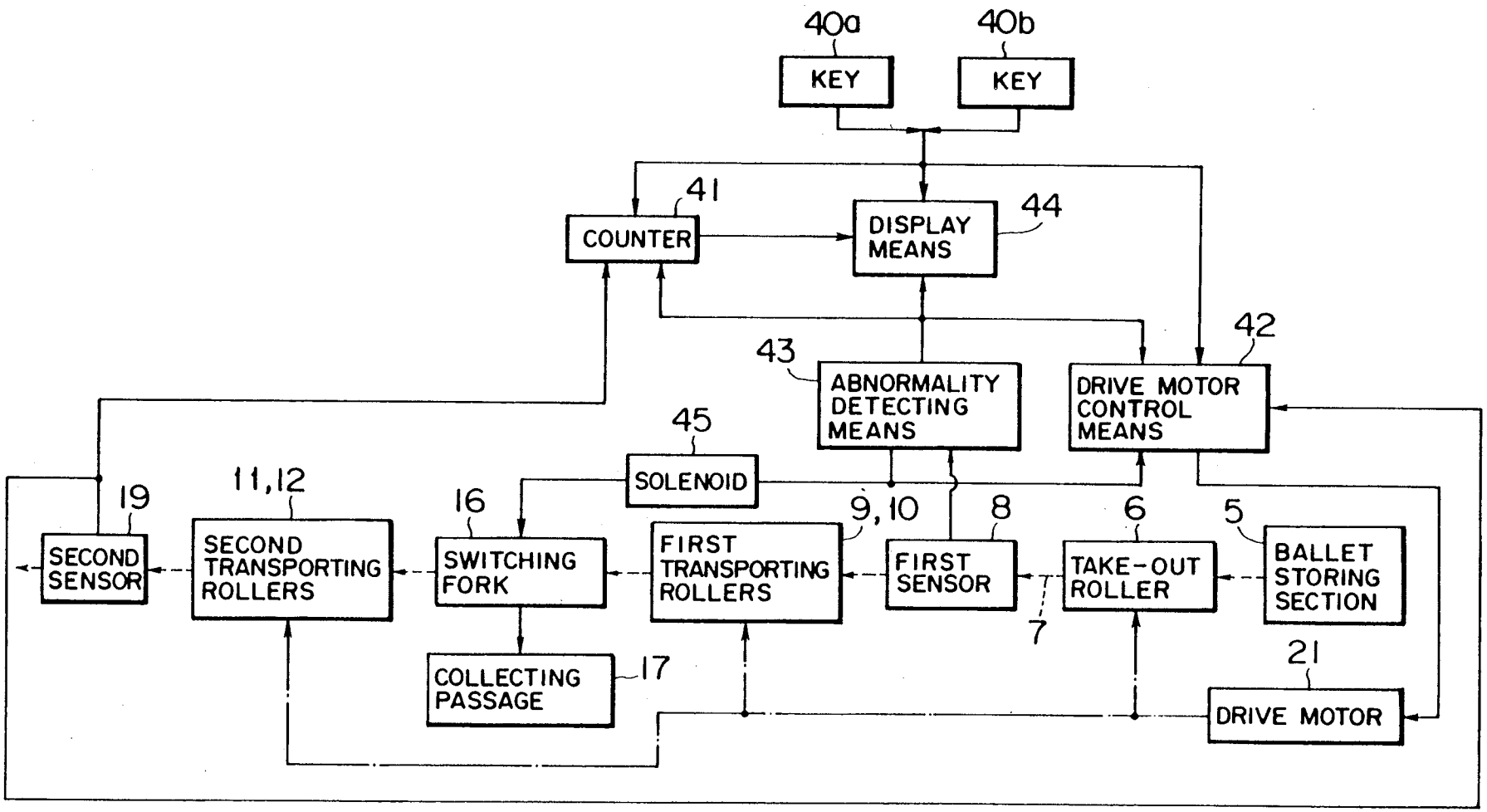
FIG. 4 is a block diagram of a ballot discriminating apparatus which is an embodiment of the present invention.

FIG. 4 is a block diagram of the ballot discriminating apparatus which is an embodiment of the present invention.

Referring to FIG. 4, the ballot discriminating apparatus comprises a key 40*a* for male voters, a key 40*b* for female voters, a counter 41 for counting the total number of issued ballots S, the total number of issued ballots S for male voters and the total number of issued ballots S for female voters, drive motor control means 42 for controlling the drive motor 21, abnormality detecting means 43 for detecting based upon a detection signal representing the amount of light emitted through a ballot S detected by the first sensor 8 whether or not a ballot S is normal and whether or not a ballot S is being normally fed, and display means 44 for displaying, based upon an output signal from the key 40*a* or 40*b*, information that one of the keys 40*a*, 40*b* has been pushed, based upon an output signal from the counter 41, the total number of issed ballots S, the total number of issued ballots S for male voters and the total number of issued ballots S for female voters, based upon an output signal from the abnormality detecting means 43, information that an abnormal situation has occurred.

The output signal from the abnormality detecting means 43 is input the solenoid 45 for driving the switching fork 16 and the counter 41 increases the total number of issued ballots S and the total number of issed ballots S for male or female voters by one when the second sensor 19 detects that a ballot S has been removed and a issue signal is input from the second sensor 19 thereto.

Figure 5:
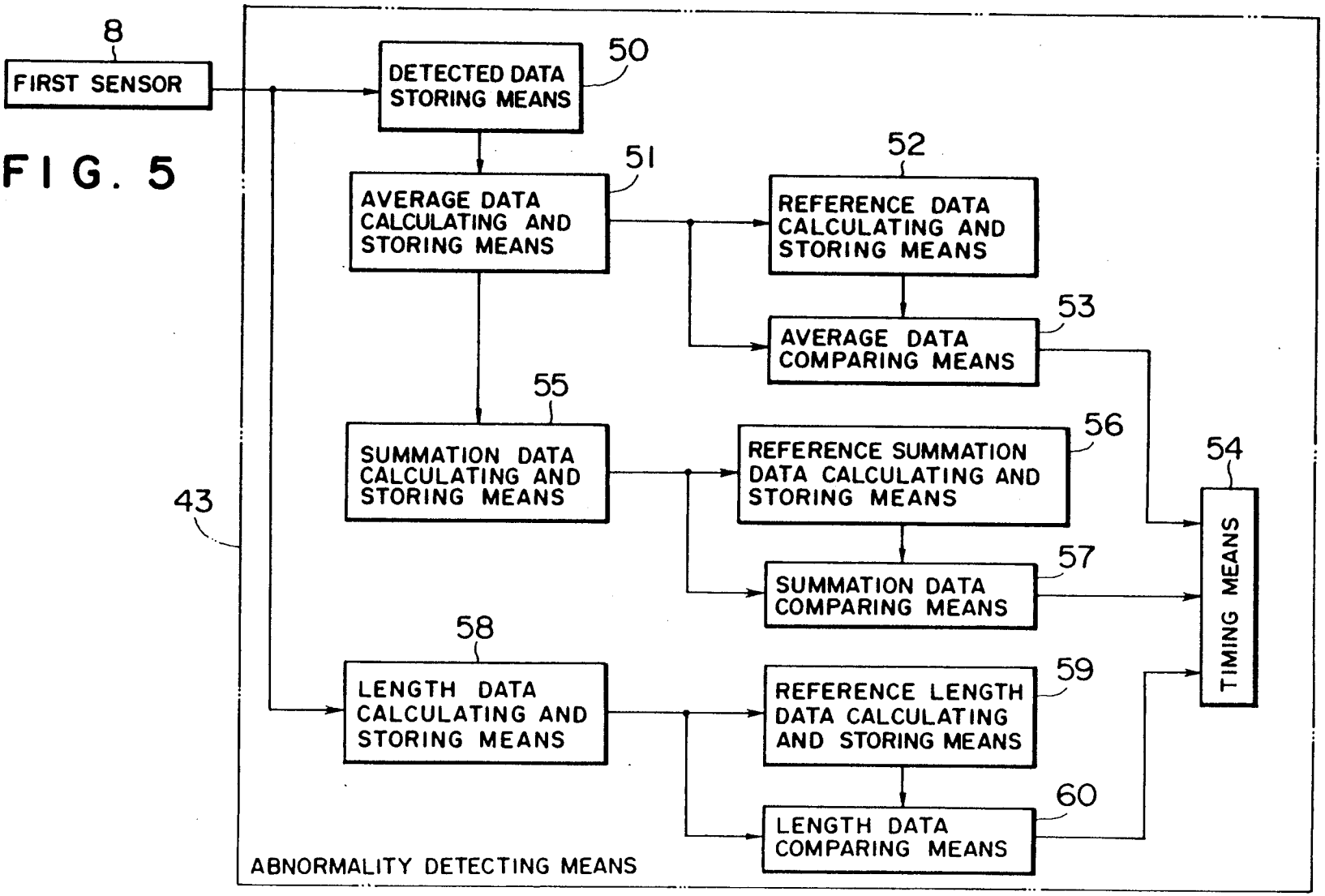
FIG. 5 is a block diagram of an abnormality detecting means.

FIG. 5 is a block diagram of the abnormality detecting means 43.

Referring to FIG. 5, the abnormality detecting means 43 comprises detected data storing means 50 for reading out and storing the amount of light transmitted through the ballot S and detected by the first sensor 8 at a predetermined time intervals, average data calculating and storing means 51 for calculating average data $D_{n,i}$ by averaging the detected data stored in the detected data storing means 50 for each of sections S1 to S10 shown in FIG. 2 and storing them, wherein n is the number of issed ballot S, i specifies which section among the sections S1 to S10 the average data is for and is an integer not less than 1 and not larger than 10, and reference data calculating and storing means 52 for calculating, based upon the average data $D_{n,i}$ calculated by the average data calculating and storing means 51, reference data $Dr_{n,i}$, reference maximum light transmittance data $Dmax_{n,i}$ and reference minimum light transmittance data $Dmin_{n,i}$ in accordance with the following formulas and storing them.

$$Dr_{k,i}=(Dr_{k,-1,}+D_{k,i})/2$$

wherein k is an integer greater than 2 and $Dr_{1,i}=D_{1,i,}$ $$Dmax_{n,i}=Dr_{n,i}+Dr_{n,i}/a$$

$$Dmin_{n,i}=Dr_{n,i}-Dr_{n,i}/b$$

wherein a and b are parameters experimentally determined.

The abnormality detecting means 43 further includes average data comparing means 53 for comparing the average data $D_{k,i}$ with the reference maximum light transmittance data $Dmax_{k-1,i}$ and the reference minimum light transmittance data $Dmin_{k-1,i}$ for each of the sections S1 to S10 based upon the average data $D_{n,i}$ *l calculated by the average data calculating and storing means* 51, *the reference maximum light transmittance data* $Dmax_{n,i}$ and the reference minimum light transmittance data $Dmin_{n,i}$ calculated by the reference data calculating and storing means 52. In the case where $D_{k,i}$ is greater than $Dmax_{k-l,i}$, since the amount of light transmitted trough the ballot S is too large and it is considered that the ballot S is not printed or erroneously printed, the average data comparing means 53 outputs an abnormal signal to a timing means 54. On the other hand, in the case where $D_{k,i}$ is less than $Dmin_{k-l,i}$, since the amount of light transmitted trough the ballot S is too small and it is considered that double feed of ballots S occurs or two or more ballots S are being fed, while they partially overlap, the average data comparing means 53 outputs an abnormal signal to the timing means 54. On the contrary, in the case where $D_{k,i}$ is not less than $Dmin_{k-l,i}$ and not greater than $Dmax_{k-l,i}$, since it is considered that the ballot S is normal and that the ballot S is being fed normally, the average data comparing means 54 outputs no abnormal signal.

Moreover, the abnormality detecting means 43 further includes summation data calculating and storing means 55 for calculating summation data $AD_n$ by summing the average value $D_{n,i}$ of all sections S1 to S10 of the ballet S and reference summation data calculating and storing means 56 for calculating, based upon the summation data $AD_n$ calculated by the summation data calculating and storing means 55, reference summation data $ADr_n$, reference summation maximum light transmittance data $ADmax_n$ and reference summation minimum light transmittance data $ADmin_n$ in accordance with the following formulas and storing them.

$$ADr_k=(ADr_{k-1}+AD_k)/2$$

wherein $ADr_1=AD_1$, $$ADmax_n=ADr_n+ADr_n/c$$

$$ADmin_n=ADr_n-ADr_n/d$$

wherein c and d are parameters determined experimentally.

The abnormality detecting means further includes summation data comparing means 57 for comparing the summation data $AD_k$ with the reference summation maximum light transmittance data $ADmax_{k-1}$ and the reference summation minimum light transmittance data $ADmin_{k-1}$ for each ballot S. In the case where the summation data comparing means 57 judges that $AD_k$ is greater than $ADmax_{k-1}$, since the amount of light transmitted the ballot S is too large and it is considered that the ballot S is not printed or erroneously printed, the summation data comparing means 57 outputs an abnormal signal to a timing means 54. On the other hand, in the case where $AD_k$ is less than $ADmin_{k-l}$, since the amount of light transmitted through the ballot S is too small and it is considered that double feed of ballots S occurs or two or more ballots are being fed in a partially overlapped condition, the summation data comparing means 57 outputs an abnormal signal to the timing means 54. On the contrary, in the case where $Ad_k$ is not less than $ADmin_{k-1}$ and not greater than $ADmax_{k-l}$, since it is considered that the ballot S is normal and that the ballot S is being fed normally, the summation data comparing means 57 outputs no abnormal signal.

Furthermore, the abnormality detecting means 43 further includes length data calculating and storing means 58 for calculating length data $L_n$ of the ballot S based upon an output signal from the first sensor 8 and storing them and reference length data calculating and storing means 59 for calculating, based upon the length data $L_n$, reference length data $Lr_n$, reference maximum length data $Lrmax_n$ and reference minimum length data $Lrmin_n$ in accordance with the following formulas.

$$Lr_k=(Lr_{k-1}+L_k)/2$$

wherein $Lr_1=L1$, $$Lrmax_n=Lr_n+Lr_n/e$$

$$Lrmin_n=Lr_n-Lr_n/f$$

wherein e and f are parameters determined experimentally.

Moreover, the abnormality detecting means 43 further includes length data comparing means 60 for comparing the length data $L_k$ with the reference maximum length data $Lrmax_{k-1}$ and the reference minimum length data $Lrmin_{k-1}$. In the case where $L_k$ is greater than $Lrmax_{k-1}$, since the detected length of ballot S is too great and it is considered that two or more ballots S are being fed, while they partially overlap, the length data comparing means 60 outputs an abnormal signal to the timing means 54. On the other hand, in the case where the length data comparing means 60 judges that $L_k$ is less than $Lrmin_{k-1}$, since the detected length of the ballot S is too small and it is considered that the ballot S is cut off or folded, the length data comparing means 60 outputs an abnormal signal to the timing means 54. On the contrary, in the case where $L_k$ is not less than $Lrmin_{k-1}$ and not greater than $Lrmax_{k-1}$, since it is considered that the ballot S is normal and that the ballot S is being fed normally, the length data comparing means 60 outputs no abnormal signal.

As described above, when at least one of the average data comparing means 53, the summation data comparing means 57 and the length data comparing means 60 detects that the ballot S is abnormal or that the ballot S is being fed abnormally, the abnormal signal is output to the timing means 54.

When the timing means 54 receives the abnormal signal before a predetermined time has passed from the start of the operation for taking out the ballot S, the timing means 54 outputs a ballot collecting signal to the solenoid 45. As a result, the switching fork 16 is driven, whereby the ballot S is collected into the collecting passage 17. Simultaneously, the timing means 54 outputs a take-out signal to the drive motor control means 42 to enable the drive motor 21 to rotate the take-out roller 6 again and a new ballot S is taken out. On the other hand, when the timing means 54 receives the abnormal signal after the predetermined time period has passed from the start of the operation for taking out the ballot S, the timing means 54 outputs a drive prohibition signal to the drive motor control means 42, a count prohibition signal to the counter 41 and a abnormality display signal to the display means 44, respectively. As a result, the drive motor 21 is stopped and the display means 44 display information that some abnormal situation has occurred. When the counter 41 receives the count prohibition signal, it does not increase the total number of issued ballots S and the total number of the issued ballots for male voters or the total number of issued ballots S for female voters, even if the issue signal is input from the second sensor 19.

In the thus constituted ballot issuing machine 1 having the ballot discriminating apparatus which is an embodiment of the present invention, the operation for issuing ballots S is started when an operator pushes the key **40*a* for male voters or the key 40*b* for female voters. Then, the start signal is input to the drive motor control means 42, thereby to drive the drive motor 21 and a display signal is input to the display means 44, thereby to enable the display means 44 to display information that a male or female voter was specified by the operator. Simultaneously, a count signal is output to the counter 41 but, as described above, the counter 41 does not count until the issue signal is input from the second sensor 19**.

Thus, when the drive motor 21 is driven, the drive pulley 23 is rotated clockwise in FIG. 1. Accordingly, the endless belt 26 engaged with the drive pulley 23, the pulley 25 and the pulley 20 are rotated clockwise, while the pulley 24 is rotated counterclockwise. As a result, the take-out roller 6 formed coaxially and integrally with the pulley 20 is rotated clockwise and the friction section **6*a* of the take-out roller 6 comes into contact with an upper face of the uppermost ballot S of the ballots S held on the upper face of the holding plate 5*a*, whereby the uppermost ballot S is fed out to the transporting path 7 by frictional force produced between the friction section 6*a*** and the upper face of the uppermost ballot S.

On the other hand, in accordance with the counterclockwise rotation of the pulley 24, the pulley 29 formed coaxially and integrally with the pulley 24 is rotated counterclockwise in FIG. 1, whereby the endless belt 30 engaged with the pulley 29, the pulley 27 and the pulley 28 are rotated counterclockwise. As a result, the first transporting roller 10 formed coaxially and integrally with the pulley 27 and the second roller 12 formed coaxially and integrally with the pulley 28 are rotated counterclockwise and the first roller 9 and the second roller 11 which are biased against the first roller 10 and the second roller 12 respectively by the plate-like spring 14 are rotated clockwise.

When the ballot S taken out by the take-out roller 6 from the ballot storing section 5 passes through the first sensor 8, the amount of light emitted from the light emitting element **8*a* and transmitted through the ballot S is detected by the light receiving element 8*b* and the transmitted light amount detection signal is fed to the abnormality detecting means 43. The ballot S is further fed to the ballot issuing opening 18 along the transporting path 7, while the speed thereof is accelerated by the first transporting rollers 9, 10 and the second transporting rollers 11, 12**.

As described above, the average data comparing means 53, the summation data comparing means 57 and the length data comparing means 60 of the abnormality detecting means 43 respectively discriminate whether or not the ballot S is abnormal and whether or not the ballot S is abnormally fed and if they judge that some abnormal situation has occurred, they output the abnormal signal to the timing means 54. When the timing means 54 receives the abnormal signal before a predetermined time has passed from the start of the operation for taking out the ballot S, the timing means 54 outputs a ballot collecting signal to the solenoid 45. As a result, the switching fork 16 is driven, whereby the ballot S is collected into the collecting passage 17. Simultaneously, the timing means 54 outputs a take-out signal to the drive motor control means 42 to enable the drive motor 21 to rotate the take-out roller 6 again and a new ballot S is taken out. On the contrary, when the timing means 54 receives the abnormal signal after the predetermined time period has passed from the start of the operation for taking out the ballot S, since the ballot has been fed to a position just before the switching fork 16 or has passed beyond the switching fork 16, it is impossible to collect the ballot S into the collecting passage 17 by driving the switching fork 16. Therefore, the timing means 54 outputs a drive prohibition signal to the drive motor control means 42 to stop the driving motor 21, thereby to stop the rotation of the take-out roller 6, the first transporting rollers 9, 10 and the second transporting rollers 11, 12. Then, in the case where the ballot S projects from the ballot issuing opening 18 to the outside, the ballot S is removed from the ballot issuing opening 18 to be collected. On the other hand, in the case where the ballot S remains in the ballot issuing machine 1, the lock mechanism 4 is released to open the upper cover 3 and the ballot S is removed and collected by lifting the handle 32 and opening the transporting path cover 31. Simultaneously with outputting the drive prohibition signal to the drive motor control means 42, the timing means 54 outputs the abnormality display signal to the display means 44, thereby to enable the display means 44 to display information that some abnormal situation has occurred and also outputs the count prohibition signal to the counter 41. As described above, the counter 41 increases the total number of issued ballots S and the total number of the issued ballots S for male voters or that for female voters by one, when the second sensor 19 detects that the ballot S has been removed and outputs the issue signal to the counter 41. However, in the case where the count prohibition signal has been input from the timing means 54, since the ballot removed from the ballot issuing opening 18 will be collected, even if the issue signal is input from the second sensor 19, the counter 41 does not count.

On the contrary, in the case where the abnormality detecting means 43 judges that the ballot S is normal and that the ballot S is being fed normally, the ballot S is fed to the ballot issuing opening 18, while the ballot S is formed with a crease at the central portion with respect to the longitudinal direction thereof. The drive motor 21 is controlled in such a manner that it stops at the time when the take-out roller rotates by one revolution and the ballot transporting mechanism is designed so that when the drive motor 21 stops, the ballot S partially projects to the outside from the ballot issuing opening 18 so as to be removable from the outside of the ballot issuing machine 1 and a part thereof can be positioned between the light emitting element **19*a* and the light receiving element 19*b* of the second sensor 19**.

Afterward, when the ballot S is removed from the ballot issuing opening 18, since no ballot S is present between the light emitting element **19*a* and the light receiving element 19*b* of the second sensor 19, the second sensor 19 detects that the ballot S has been removed and outputs the issue signal to the counter 41 and a reset signal to the drive motor control means 42**.

When the counter 41 receives the issue signal from the second sensor 19, unless it has received the count prohibition signal from the abnormality detecting means 43, it increases the total number of issued ballots S and that for male voters or that for female voters in accordance with the count signal input from the key **40*a* or 40*b*, and outputs an issued ballot number signal to the display means 44, thereby to enable the display means 44 to change the number of issued ballots S displayed thereon. The count signal can be amended before the issue signal is input from the second sensor 19 and, therefore, even if the operator pushed the wrong key 40*a* or 40*b*, if the operator pushes the right key 40*a* or 40*b*** before the ballot S is removed, the total number of issued ballots S for male voters or that for female voters can be correctly counted.

Further, the drive motor control means 42 is constituted in such a manner that it does not drive the drive motor 21 before the reset signal is input from the second sensor 19 and, therefore, even in the case where, after the drive motor 21 has rotated the take-out roller 6 by one revolution to feed the ballot S to a predetermined position and was stopped and before the ballot S is removed from the ballot issuing opening 18, the operator comes to realize that the wrong key **40*a* or 40*b* was pushed and pushes the right key 40*a* or 40*b*, since the drive motor 21 is not driven, a new ballot S is prevented from being taken out from the ballot storing section 5**, without fail.

As described in detail, according to this embodiment, since abnormality of the ballot S and abnormal feed of the ballot S are discriminated based upon the average amount of light transmitted through each of the sections S1 to S10 of the preceding ballot S, the summation value of the average amount of the light transmitted through each of the sections S1 to S10 of the preceding ballot S and the length of the preceding ballot S, in the case where the kind of the ballot S is changed, it is possible to discriminate whether or not the ballot S is abnormal and whether or not the ballot S is being abnormally fed with high accuracy and without any modification of the ballot issuing machine 1 itself.

As described in detail with reference to the preferred embodiment, according to the present invention, it is possible to provide a sheet discriminating apparatus capable of discriminating whether or not sheets are of a specified kind and/or whether or not abnormal feed of sheets such as double feed occurs for various kinds of sheets.

The present invention has thus been shown and described with reference to the specific embodiment. However, it should be noted that the present invention is in no way limited to the details of the described arrangements but changes and modifications may be made without departing from the scope of the appended claims.

For example, in the above described embodiment, although an amount of light transmitted through the ballot S is detected for each of the sections S1 to S10, the number of the sections may be determined greater than 10 or less than 10.

Further, in the above described embodiment, although when the timing means 54 receives the abnormal signal before the predetermined time period has passed, it turns the solenoid 45 on and the ballot S is collected into the collecting passage 17 by the switching fork 16, while when the timing means 54 receives the abnormal signal after the predetermined time period has passed, the drive motor 21 is stopped by the drive motor control means 42 and the ballot S is removed and collected from the transporting path 7 by opening the upper cover 3 and the transporting path cover 31 or from the ballot issuing opening 18, it is possible to collect the ballot S without the timing means in such a manner that, for example, the abnormal signal from the average data comparing means 53 is input to the solenoid 45 and the ballot S is collected into the collecting passage 17 by the switching fork 16, while the abnormal signal from the summation data comparing means 57 or the length data comparing means 60 is input to the drive motor control means 42, thereby to stop the drive motor 21 and collect the ballot S. Moreover, if the first sensor 8 and the switching fork 16 can be arranged such that the distance between them is sufficiently long, it is possible to output all of the abnormal signals from the average data comparing means 53, the summation data comparing means 57 and the length data comparing means 60 to the solenoid 45, thereby to collect the ballot S by the switching fork 16 without the timing means 54.

Furthermore, in the above described embodiment, although explanation is made as to the case where the present invention is applied to the ballot discriminating apparatus of the ballot issuing machine 1, the present invention can be applied for discriminating whether or not other sheets such as bills are abnormal and whether or not other sheets such as bills are being abnormally fed.

Further, it is possible to discriminate only one or the other of sheet abnormality and sheet abnormality feed.

Still further, it should be noted that each means defined in the appended claims does not necessarily means physical means and that cases where the function of each means can be accomplished by software fall within the scope of the present invention. For example, the function of one means defined in the appended claims may be accomplished by two or more physical means and two or more means defined in the appended claims may be accomplished by one physical means in the present invention.

We claim:

1. A sheet discriminating apparatus comprising light emitting means for emitting light onto a sheet being transported, light receiving means for detecting an amount of light transmitted through the sheet and sheet discriminating means for discriminating a specified kind of the sheet from others and/or abnormal feed of sheets based upon the amount of light transmitted through the sheet detected by said light receiving means, said sheet discriminating means comprising average value calculating and storing means for calculating and storing an average value of the amount of light transmitted through the sheet detected by said light receiving means for each of sections into which the sheet is subdivided, reference data calculating and storing means for calculating and storing a reference data for each of the sections of the sheet based upon the average value of light transmitted through a preceding sheet to the sheet to be discriminated stored in said average value calculating and storing means, and average data comparing means for comparing the average value of the amount of light transmitted through the sheet calculated in said average value calculating and storing means with the reference data calculated by said reference data calculating and storing means section by section and discriminating the specified kind of sheet from others and/or abnormal feed.

2. A sheet discriminating apparatus in accordance with claim 1 wherein said sheet discriminating means further includes summation value calculating and storing means for calculating and storing a summation value by summing the average values calculated by and stored in said average value calculating and storing means over the entire area of the sheet, reference summation value calculating and storing means for calculating and storing a reference summation data based upon the summation value of the amount of light transmitted through the preceding sheet to the sheet to be discriminated stored in said summation value calculating and storing means, and summation value comparing means for comparing the summation value calculated by said summation value calculating and storing means with the reference summation value calculated by said reference summation value calculating and storing means and discriminating the specified kind of the sheet from others and/or abnormal feed of sheets.

3. A sheet discriminating apparatus in accordance with claim 1 wherein said sheet discriminating means further includes length calculating and storing means for calculating and storing a length of the sheet based upon the amount of light transmitted through the sheet detected by said light receiving means, reference length data calculating and storing means for calculating and storing a reference length data based upon the length of the preceding sheet to the sheet to be discriminated stored in said length calculating and storing means, and length data comparing means for comparing the length of the sheet calculated by said length calculating and storing means with the reference length data calculated by said reference length data calculating and storing means and discriminating the specified kind of the sheet from others and/or abnormal feed of sheets.

4. A sheet discriminating apparatus in accordance with claim 2 wherein said sheet discriminating means further includes length calculating and storing means for calculating and storing the length of the sheet based upon the amount of light transmitted through the sheet detected by said light receiving means, reference length data calculating and storing means for calculating and storing a reference length data based upon the length of the preceding sheet to the sheet to be discriminated stored in said length calculating and storing means, and length data comparing means for comparing the length of the sheet calculated by said length calculating and storing means with the reference length data calculated by said reference length data calculating and storing means and discriminating the specified kind of the sheet from others and/or abnormal feed of sheets.

* * * * *